United States Patent [19]

Loftis

[11] 3,965,628

[45] June 29, 1976

[54] DRILL MAST SUPPORT ASSEMBLY

[75] Inventor: James B. Loftis, Remlap, Ala.

[73] Assignee: Joy Manufacturing Company, Pittsburgh, Pa.

[22] Filed: Mar. 26, 1975

[21] Appl. No.: 562,175

Related U.S. Application Data

[63] Continuation-in-part of Ser. No. 458,331, April 5, 1974, abandoned.

[52] U.S. Cl. ..... 52/115; 52/116; 173/26; 173/44

[51] Int. Cl.[2] ..... E04H 12/34; E21C 11/02

[58] Field of Search ..... 173/26–28, 173/40–44; 52/116, 117, 115

[56] References Cited

UNITED STATES PATENTS

| | | | |
|---|---|---|---|
| 2,849,212 | 8/1958 | Robbins | 173/28 X |
| 2,904,310 | 9/1959 | Leonard | 173/28 X |
| 3,012,619 | 12/1961 | Farque | 173/28 X |
| 3,252,527 | 5/1966 | Alexander et al. | 173/41 |
| 3,778,940 | 12/1973 | Blecken | 52/116 |
| 3,805,463 | 4/1974 | Lang et al. | 173/28 X |
| 3,815,690 | 6/1974 | Cooper | 173/44 |

*Primary Examiner*—Ernest R. Purser

[57] ABSTRACT

A drill mast support assembly having a drill mast pivotable between a drilling and a non-drilling position and including elongated rigid brace means for stabilizing the mast in the drilling position. The brace means are connected to the mast by support means which provide for a compact assembly when the mast in the non-drilling position and permit the brace means to be automatically positioned as the drill mast is moved to the drilling position. Lock means are further provided for preventing relative movement between the mast and the brace means when the mast is in the drilling position.

10 Claims, 8 Drawing Figures

DRILL MAST SUPPORT ASSEMBLY

This application is a continuation-in-part of copending application Ser. No. 458,331, filed Apr. 5, 1974 and now abandoned.

In the art of earth drilling it is well known to provide large drilling rigs, blast hole drills for example, for the purpose of drilling deep holes into the earth. Such drilling rigs have commonly included an elongated drilling mast pivotally carried by a mobile support base and movable with respect thereto intermediate a collapsed or inoperative position and an operative position. In the prior art difficulty has commonly been encountered in the preparation of such rigs for drilling operation. For example often such rigs have been provided with rotary power coupling means for transmitting rotary drilling power to the drilling apparatus carried by the mast. However, in the prior art such couplings have typically been disengaged when the mast was in the inoperative position and have required considerable manual effort to recouple when moving the mast to the operative position. Additionally, difficulties have been encountered in securing the latch or locking devices used to lock the drilling mast in the operative position, again due to the extensive manual effort typically required.

The present invention alleviates these and other shortcomings of prior art drilling rigs by providing a rotary power transmitting coupling which automatically and quickly engages or disengages upon movement of the drilling mast to or from the operative position, respectively, and powered latch or lock means for securing the drill mast in the operative position thereof. The improved latch means further provides for more efficient handling and securing of the struts commonly utilized to brace upper portions of the drill mast in the operative position.

These and other objects and advantages of the present invention are more fully specified in the following description with reference to the accompanying figures wherein.

Figure 2:
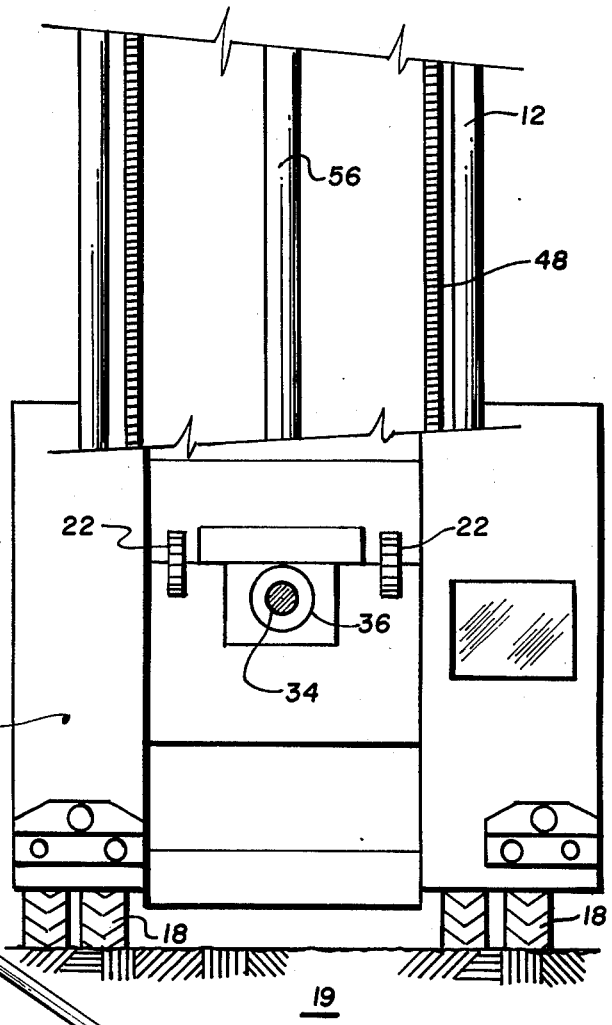
FIG. 2 is an end elevation of the drilling apparatus of FIG. 1 taken from line 2—2 of FIG. 1 with the drill mast shown partially broken away.
Figure 1:
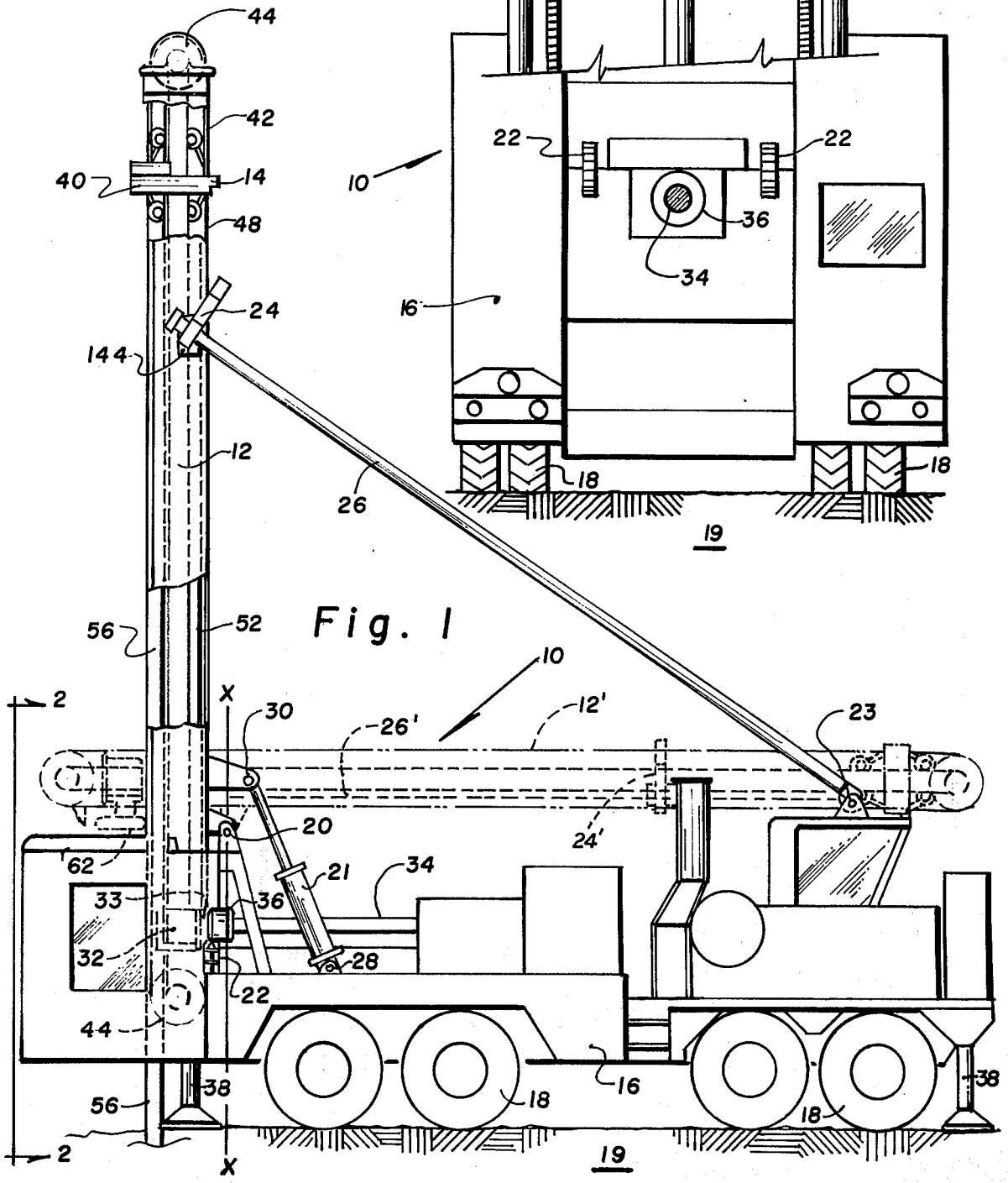
FIG. 1 illustrates in side elevation a drilling apparatus embodying the present invention.

There is generally indicated at 10 in FIGS. 1 and 2 a mobile drilling apparatus constructed in accord with the principles of the present invention. In practice the apparatus 10 may take the form of any of various well known drilling rigs adapted to bore holes generally downwardly into the earth but for purposes of illustration is herein shown as a blast hole drill. Accordingly, as shown the apparatus 10 comprises an elongated boom or mast assembly shown at 12 in the upright or operative position thereof and including well known drilling means 14 movably carried thereon for drilling holes downwardly into the earth in a manner well known in the art. Boom 12 is shown as being carried adjacent a rearward end portion of any suitable mobile base such as a truck 16 having wheels 18 which render the apparatus 10 readily movable over terrain 19 and preferably over rough terrain such as commonly encountered in open pit mines, quarries, construction sites and other locations where the use of such drills may often be required.

To facilitate traverse of such rough terrain by the apparatus 10 boom 12 is pivotally carried by truck a frame or 16 as for example by means of a transversely disposed pivot pin 20 connecting a lower portion of the boom 12 to a rearward portion of truck 16 to render boom 12 pivotal in a vertical plane intermediate the operative drilling position thereof and a generally horizontal or collapsed non-drilling position thereof atop the truck 16 as indicated by phantom lines at 12' in FIG. 1. Those versed in the art will readily appreciate that the upright or operative position of boom 12 is not well suited for traversing of the terrain by apparatus 10 and that pivoting the boom 12 to the collapsed position 12' greatly facilitates such traversing, for example by decreasing apparatus top weight and increasing stability, and by minimizing clearance problems with respect to obstacles in the path to be traversed.

For powered movement of the boom 12 intermediate the operative and collapsed positions as described hereinabove there is provided any suitably adapted power means such as a fluid operable extensible piston and cylinder assembly 21 pivotally connected adjacent opposed longitudinal ends thereof to the truck 16 and the boom 12, respectively, by respective pivot pins 28 and 30 disposed on axes parallel to the axis of pivot 20. Assembly 21 includes any suitable fluid control means (not shown) cooperable therewith for selective powered extension and retraction thereof to selectively pivot the boom 12 intermediate the respective operative and collapsed positions.

To secure boom 12 in the operative position during drilling operations there is provided a plurality of powered latch or lock means comprised of lower latch or lock assemblies 22 carried by a lower rearward portion of the truck 16 (FIG. 3) and operable to engage a lower portion of the boom 12, and upper latch or lock assemblies 24 carried by laterally opposed upper side portions of the boom 12 and operable to engage outer end portions of respective, laterally spaced elongated diagonal struts or braces 26 which are pivotally secured as at 23 adjacent the opposite longitudinal ends thereof to the truck 16 for pivoting in substantially vertical planes. The latch assemblies 22 and 24 may be powered by any suitable means, for example by fluid operable extensible piston and cylinder assemblies such as described hereinbelow and may advantageously be provided with common control means for coincident operation of the respective latches and simplified control thereof.

Figure 3:
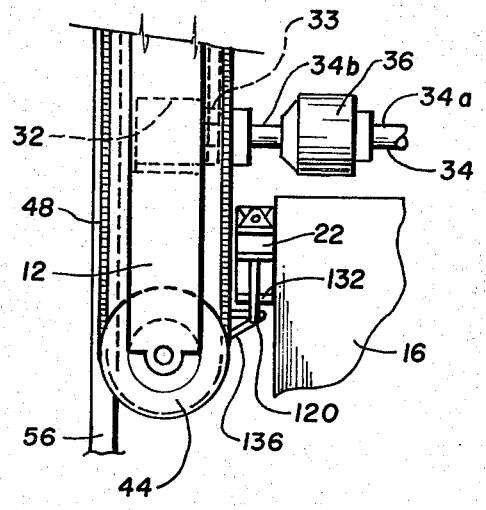
FIG. 3 is an enlarged fragmentary portion of FIG. 1 illustrating the coupling means and the lower latch means of this invention.

The apparatus 10 is further provided with rotary power means for driving the drilling apparatus 14, for example a power takeoff (not shown) from the engine of truck 16 which is drivingly connected as through a longitudinally extending torque transmitting shaft 34 to a first drill transmission 32 rigidly carried by a lower portion of boom 12. As shown in FIG. 3, the shaft 34 includes forward and rearward axially aligned shaft portions 34*a* and 34*b*, respectively, which are drivingly engaged at the respective adjacent ends thereof by a torque transmitting coupling 36. As will be evident in light of the description hereinabove, the shaft portion 34*a* is operative as the power output shaft of the hereinabove mentioned rotary power means (not shown), and the shaft portion 34*b* is operative as the power input shaft of transmission 32. Furthermore, it will become apparent hereinafter that coupling 36 is operative to transmit torque loads between the shaft portions 34*a* and 34*b* only when boom 12 is in the operative position thereof.

In practice, preparation for drilling operations involves positioning the truck 16 adjacent the selected drilling location and stabilizing and leveling the truck as by means of well known front and rear leveling jacks 38 to provide a solid base from which to perform the required drilling. Further preparatory to drilling, the boom 12 is pivoted from the collapsed position 12' thereof in which it had been disposed for movement of the truck 16 over the terrain to the operative position thereof whereat the axially aligned shaft portions 34*a* and 34*b* are joined in torque transmitting engagement by coupling 36 for the transmitting of power to the drilling means 14, and latches 22 and 24 are actuated to secure boom 12 in the operative position.

Drilling operations comprise the employment of rotary power supplied through shaft 34 to drive the drilling means 14 which comprises, in addition to the transmission 32, a second drill transmission 40 carried by boom 12 and selectively movable longitudinally therealong as by means of a well known chain and sprocket assembly 42 having a chain 48 passing around sprockets 44 adjacent opposed ends of the boom 12 and adapted for orbital circulation with respect thereto.

The transmission 40 is suitably affixed to the chain 48 whereby, by actuation of any suitable power means (not shown) adapted to power the chain 48 in such orbital circulation, transmission 40 may be selectively moved longitudinally of boom 12. Drilling means 14 further includes an elongated power shaft 52 of polygonal cross section extending longitudinally of boom 12 and journaled for axial rotation adjacent upper and lower ends thereof to an upper portion of boom 12 and to the power output of transmission 32 as at 33. Shaft 52 extends in a known manner in sliding engagement through an annular input drive portion of transmission 40 having a polygonal cross section which mates with the periphery of shaft 52 for rotary driving engagement therebetween whereby transmission 40 is adapted to receive rotary driving power coincidentally with movement thereof longitudinally of the boom 12 under the impetus provided by chain and sprocket assembly 42.

In practice a drill string 56 is suitably affixed to a rotary power output portion of transmission 40 whereby there is imparted to string 56 a selectively controllable downwardly directed rotary drilling action for drilling holes as desired in the earth.

Figure 5:
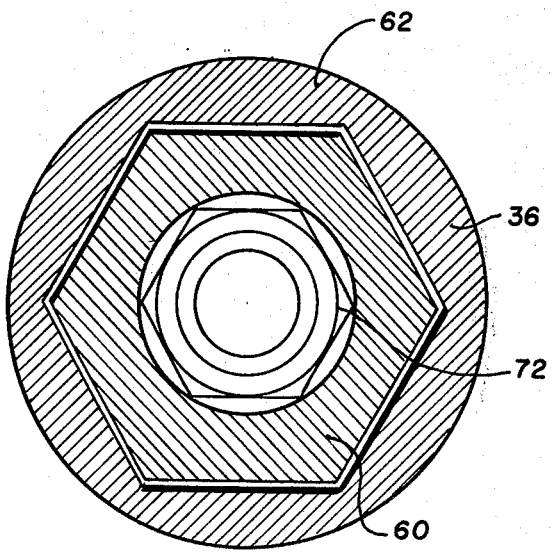
FIG. 5 is a transverse section taken on line 5—5 of FIG. 4.
Figure 4:
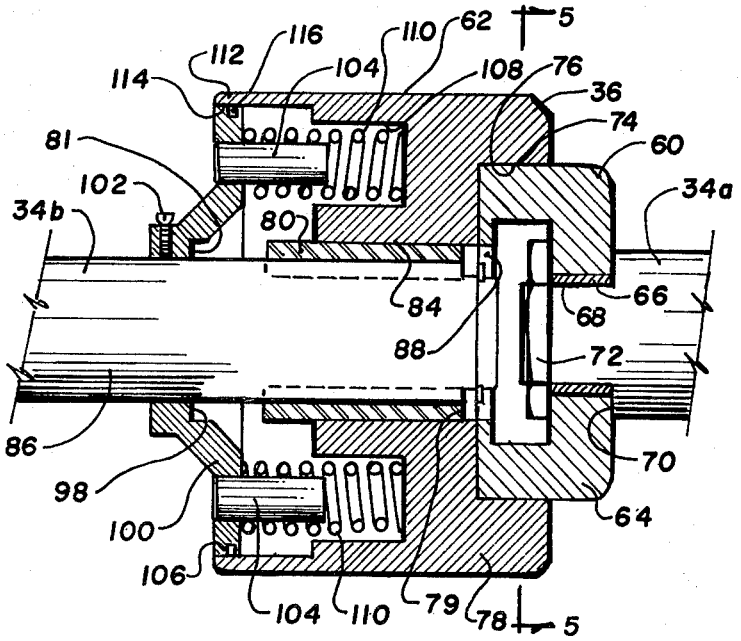
FIG. 4 is an enlarged longitudinal section of the coupling of FIG. 3.

During ongoing drilling operations, power to drive the means 14 is provided by shaft 34 via the coupling 36 which as shown in FIGS. 3, 4 and 5 comprises respective engageable male and female members 60 and 62 carried by the adjacent ends of shaft portions 34*a* and 34*b*, respectively. The male member 60 comprises a generally annular body 64 rigidly affixed coaxially to a rearward end portion of shaft 34*a* as by being non-rotatably keyed thereonto by a shear pin 66 disposed within keyways 68, and by being captively retained axially intermediate a nut 72 threadingly engaging the rearwardmost end of the shaft 34*a* and an annular shoulder portion 70 of shaft 34*a* spaced forwardly from nut 72. The body 64 includes an outer polygonal periphery 74 adapted to engage in rotary driving engagement a mating inner peripheral portion 76 of member 62.

The member 62 comprises a generally annular body member 78 having the inner peripheral portion 76 formed therein adjacent the forwardmost end thereof. Body 78 is mounted upon a forward end portion of shaft 34*b* as follows. The body 78 includes therein an axial opening formed by an internally splined cylindrical sleeve member 80 suitably rigidly affixed as by weldments within a through bore 84 extending axially within member 78. The sleeve 80 receives axially therewithin a cooperably splined end portion 86 of the shaft 34*b* such that member 78 is non-rotatably carried by shaft 34*b* and longitudinally slidable with respect thereto intermediate a forward stop 79 and a rearward stop 81. At forward stop 79 the forward end of sleeve 80 axially abuts a washer 88 disposed coaxially with respect to shaft 34*b* adjacent the forwardmost end thereof and suitably affixed thereat so as to be restrained against axial movement. At rearward stop 81 the rearward end of sleeve 80 axially abuts an annular face 98 of an annular spring plate 100 which is affixed coaxially to shaft 34*b* rearwardly of member 78 as by means of one or more set screws 102. The plate 100 carries a plurality of angularly spaced, forwardly extending spring retainer pins 104 as by having the pins 104 suitably rigidly affixed within respective axially extending through bores 106 within the plate 100. Each of pins 104 is aligned with one of a respective plurality of rearwardly opening recesses 108 formed within the body member 78 such that a respective plurality of helical compression springs 110 may be retained coaxially within recesses 108 and about pins 104 and extending intermediate plate 100 and member 78 so as to provide a biasing force therebetween urging the member 78 forwardly against stop 79.

It will be seen by reference to FIG. 4 that the member 78 further includes a rearwardly extending coaxial cylindrical skirt portion 112 which slidably, sealingly receives therewithin an outer peripheral portion 114 of plate 100 as by means of any suitable annular seal 116 disposed radially therebetween to sealingly encase the springs 110 thereby precluding entry of airborne dust and dirt generated during drilling.

In practice the coupling 36 is disposed such that the male and female members 60 and 62, respectively, are readily engageable in driving relation upon pivoting of the mast 12 to the operative position thereof. As shown in FIG. 3 for example, coupling 36 is positioned on a line X—X paralleling the axis of boom 12 and passing through the boom pivot 20 such that as boom 12 is pivoted to the operative position thereof the coupling member 62 moves in an arcuate path which, at the point of engagement of members 60–62, is substantially tangent to the axis of shaft portion 34*a* and member 60 whereby the coupling operation is considerably simplified.

As will be clear from perusal of FIGS. 1 and 3, the coupling members 60 and 62 are in driving engagement only when the boom is in the operative position as shown in solid lines at 12. Upon initial pivoting of boom 12 toward the collapsed position 12' the coupling member 62 moves substantially rearwardly and substantially tangentally with respect to the axis of member 60 to break driving engagement between the respective mating peripheral portions 76 and 74 thereof, and thence moves arcuately rearwardly and upwardly to the position 62′ as the boom 12 is pivoted into the collapsed position 12′.

Upon returning the boom 12 to the operative position the member 62 moves arcuately downwardly and forwardly to once again engage the member 60 in driving relation as hereinabove described. The mechanical shock of the initial contact between the members 60 and 62 upon reengagement thereof is absorbed by sliding movement of the member 78 rearwardly upon splined shaft portion 86 to compress springs 110 whereby the excessive wear and damage commonly resulting in the prior art from repeated engagement of such couplings is minimized. The capacity for axial movement of the member 78 upon shaft portion 86 additionally assists in the engagement of members 60 and 62 by aiding in the alignment of the respective members after initial contact therebetween and before final driving engagement thereof is achieved. Still further, in the fully engaged configuration of the coupling 36 the member 78 may be displaced axially rearwardly from forward stop 79 as shown in FIG. 4 by forceful contact with member 60 whereby the resulting forward bias of springs 110 provides improved driving engagement between the members 60 and 62 and compensates for any axial play therebetween.

Figure 6:
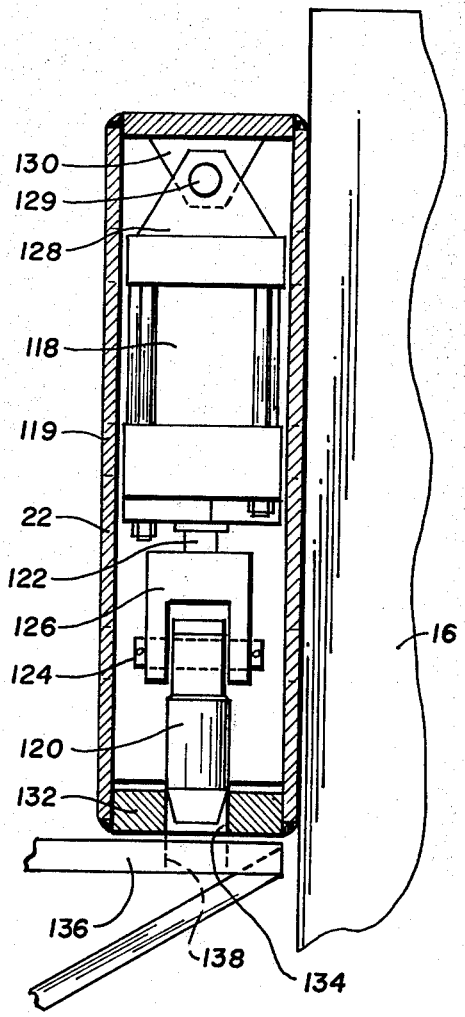
FIG. 6 is an enlarged longitudinal section of the latch means of FIG. 3.

As hereinabove indicated, the operative position of the boom 12 is maintained by lower and upper powered latch assemblies 22 and 24, respectively. One of lower latch assemblies 22 is shown in FIGS. 3 and 6 as comprising a housing 119 rigidly affixed to the truck 16 and carrying therewithin a fluid operable extensible piston and cylinder assembly 118 having a latch element 120 carried adajcent the outermost end of a piston rod portion 122. The latch element 120 is pivotally affixed to the rod 122 as by being pivoted by a pin 124 intermediate the legs of a clevis member 126 rigidly affixed to the outermost end of the rod 122. The opposed longitudinal end of assembly 118 is similarly pivotally affixed adjacent an upper end portion of the housing 119 as by having a lug portion 128 thereof being pivoted by means of a pin 129 to a cooperable lug 130 rigidly affixed to the housing 119 such that the entire assembly 118 depends from the pin 129 within housing 119. Adjacent the lower end of housing 119 there is provided a transversely extending latch guide plate 132 having an aperture 134 therethrough to receive and guide the latch element 120. The boom 12 includes a latch plate portion 136 rigidly affixed adjacent a lower rearward portion thereof and cooperable with the latch 22 whereby, as the boom 12 is pivoted to the operative position thereof, the plate 136 is moved arcuately downwardly and forwardly to a position subjacent the plate 132 whereat an aperture 138 in the plate 136 registers with aperture 134 to receive the latch element 120. Upon subsequent actuation of the assembly 118 to extend rod 122, latch element 120 extends within the apertures 134 and 138 to secure the latch plate 136 with respect to latch assembly 22 thereby securing the boom 12 in operative position thereof.

Figure 7:
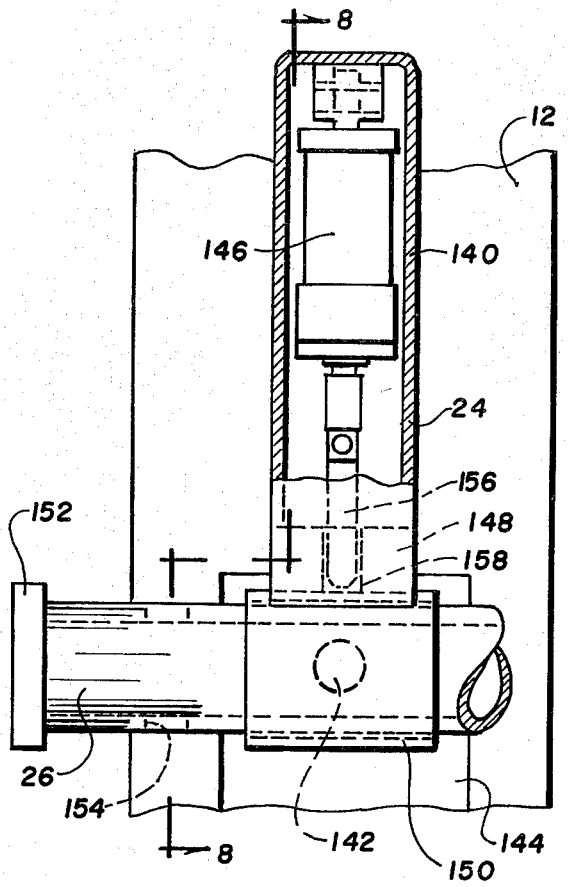
FIG. 7 is a fragmentary portion of FIG. 1 illustrating, partially in section, the upper latch assembly of this invention.
Figure 8:
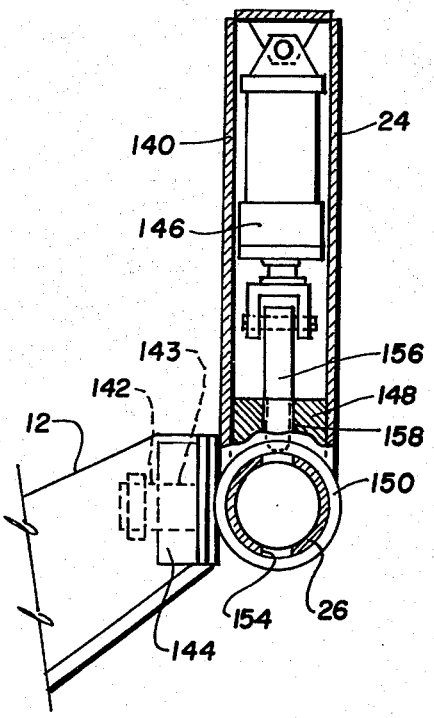
FIG. 8 is a sectional view of the upper latch taken on line 8—8 of FIG. 7.

Coincidentally with the engagement of lower latches 22, the upper latches 24 may advantageously be engaged to further secure the boom 12 in the operative position. Preferably there are provided at least two latches 24 carried adjacent laterally opposed sides of boom 12, and as shown in FIGS. 1, 7 and 8 each opposed sides of boom 12, and as shown in FIGS. 1, 7 and 8 each latch assembly 24 includes a housing 140 pivotally carried adjacent one lateral side of an upper portion of boom 12 as by means of a transverse pivot pin 142 rigidly affixed to the housing 140 and extending transversely therefrom through a transverse bore 143 in a support portion 144 of the boom 12. As shown the housing 140 carries therewithin a suitable fluid operable extensible piston and cylinder assembly 146, for example having a form and construction identical to that of the assembly 118 described hereinabove for the latches 22. The housing 140 includes a cylindrical sleeve guide portion or support 150 rigidly affixed subjacent a lower transversely extending latch guide plate 148 thereof, which sleeve 150 is adapted to slidably receive therewithin one of struts 26 (FIG. 1). Preferably the axis of pin 142 intersects the axis of the sleeve 150 as shown whereby the tendency for sleeve 150 to bind upon strut 26 during sliding movement therealong is minimized.

Each strut 26 includes an end cap 152 which precludes separation of the strut 26 from the respective sleeve 150, and an aperture 154 spaced from the end cap 152 and adapted to receive a latch element 156 of the assembly 146. Each of the assemblies 146 is concomitantly operable with assemblies 118 of latches 22 to drive the elements 156 through a guide aperture 158 extending within guide plate 148 and sleeve 150 to engage the aperture 154 of the respective strut 26 whereby the mast 12 is rigidly secured and braced in the operative position thereof by the cooperating latches 22 and 24.

It will be evident from the recitations hereinabove that as boom 12 is pivoted from the operative position to the collapsed position thereof struts 26 are also lowered from their diagonal operative position whereat they brace the upper portion of boom 12, to a collapsed position 26′ (FIG. 1) substantially parallel to the collapsed position 12′ of boom 12. More particularly, as boom 12 is pivoted to the collapsed position 12′ the upper portions thereof move arcuately downwardly and forwardly whereby the guide sleeves 150 of latches 22 slide forwardly along the respective struts 26 to the position indicated at 24′ thereby pivoting struts 26 about their respective pivots 23 downwardly to the collapsed position 26′. It will be appreciated that the sliding engagement of struts 26 within sleeves 150 is maintained at all times thereby substantially simplifying the process of boom manipulation as described hereinabove. It is further evident as shown in FIG. 1 that in order for the above-described relative movement between the mast 12 and the struts 26 to be possible, the pivotal axis 20 between the boom 12 and the frame 16 must be closer to the pivotal axis 142 of the support sleeves 150 than it is to the pivotal axis 23 of the struts 26. If this were not the case the struts 26 would always pivot in the same direction as the mast 12 resulting in, for example, a substantially less desirable collapsed position wherein the struts 26 extend outwardly of the mast 12 and the frame 16.

According to the foregoing description there is provided by the present invention a drilling apparatus including a pivotal drill mast with improved rotary power coupling means and improved lock or latch means for securing the mast in the operative position for drilling. Notwithstanding the reference hereinabove to a particular drilling structure it is to be recognized that the improvements of the present invention may be practiced in a variety of embodiments with various modifications thereto without departing from the broad spirit and scope thereof. For example: it is contemplated that latches 22 and 24 may be operable by means other than fluid pressure actuating means, a solenoid for example; the particular manner of sliding engagement latching between latches 24 and braces 26 may be varied within a broad design latitude; and the like. These and other embodiments and modifications having been envisioned by the inventors, it is requested that the invention be interpreted broadly and limited only by the scope of the claims appended hereto.

What is claimed is:

1. A drill mast support assembly comprising: an elongated frame, an elongated drill mast connected to said frame adjacent one end portion of said mast for selective pivotal movement about a first pivot axis between a drilling position and a non-drilling position; elongated rigid brace means supported adjacent one end by said frame and pivotable with respect thereto about a second pivot axis which is parallel to said first pivot axis; support means on said mast connecting said brace means and said mast adjacent the end portion of said mast opposite said on end portion to permit relative longitudinal and pivotal movement of said mast with respect to said brace means throughout the pivotal movement of said mast with respect to said frame; said mast being pivotable with respect to said brace means about a third pivot axis which is parallel to said first and second pivot axes and movable with respect thereto; the distance between said first and second pivot axes being greater than the distance between said first and third pivot axes; and the longitudinal axes of said frame, said mast and said brace means being generally parallel to each other when said mast is in said non-drilling position.

2. The assembly as specified in claim 1 additionally comprising: selectively operable locking means for preventing relative movement between said drill mast and said brace means when said drill mast is in said drilling position.

3. The assembly as specified in claim 2 wherein said locking means includes: at least one transverse bore in said brace means adjacent the other end thereof; and at least one pin assembly carried by said drill mast and movable between a first position outside said bore and a second position inside said bore.

4. The assembly as specified in claim 3 wherein: said locking means additionally includes a remote control actuator; and said pin is selectively movable by said actuator.

5. The assembly as specified in claim 1 wherein: said elongated brace means comprises a pair of cylindrical rods laterally spaced on either side of said drill mast.

6. The assembly as specified in claim 5 wherein: said support means includes a pair of sleeves respectively surrounding adjacent portions of said rods; said sleeves being pivotally mounted on opposite sides of said drill mast and slidable on said rods respectively.

7. The assembly as specified in claim 6 additionally comprising: selectively operable locking means for preventing relative movement between said drill mast and said rods when said drill mast is in said drilling position; said locking means including a bore through each of said rods and a pin assembly movably mounted on each of said sleeves and adapted to be inserted into a respective one of said bores to prevent relative movement between said rods and said sleeves.

8. The assembly as specified in claim 7 wherein: said locking means additionally includes remote controlled actuators; and said pins are selectively movable by said actuators.

9. The assembly as specified in claim 1 additionally comprising: stop means on said brace means at the opposite end thereof for preventing the brace means from becoming separated from said support means.

10. The assembly as specified in claim 1 wherein said drilling position of said drill mast is a vertical position and said non-drilling position is a horizontal position.

* * * * *

UNITED STATES PATENT OFFICE

CERTIFICATE OF CORRECTION

Patent No. 3,965,628 Dated June 29, 1976

Inventor(s) James B. Loftis

It is certified that error appears in the above-identified patent and that said Letters Patent are hereby corrected as shown below:

Claim 1, line 11 delete "on" and insert -- one --.

Claim 4, line 2 delete "control" and insert -- controlled --.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*